US006514011B2

(12) United States Patent
Nomura et al.

(10) Patent No.: US 6,514,011 B2
(45) Date of Patent: Feb. 4, 2003

(54) MOVABLE WATER-PROTECTION APPARATUS

(76) Inventors: Yasuhiro Nomura, 502 Maison Riviere, 2-15-13 Nishikawa, Amagasaki-shi, Hyogo (JP); Kazuo Yano, 898-9 Shinmachi, Yamato-Kohriyama-shi, Nara (JP)

( * ) Notice: Subject to any disclaimer, the term of this patent is extended or adjusted under 35 U.S.C. 154(b) by 0 days.

(21) Appl. No.: 09/742,067

(22) Filed: Dec. 22, 2000

(65) Prior Publication Data

US 2001/0006591 A1 Jul. 5, 2001

(30) Foreign Application Priority Data

| | | |
|---|---|---|
| Dec. 22, 1999 | (JP) | 11-364499 |
| Jul. 14, 2000 | (JP) | 2000-214187 |
| Dec. 27, 2000 | (JP) | 2000-398052 |
| Jan. 10, 2001 | (JP) | 2001-002530 |
| Jan. 31, 2001 | (JP) | 2001-023947 |

(51) Int. Cl.[7] ..... E02B 7/40; E02B 7/28; E02B 7/36; E02B 3/10

(52) U.S. Cl. ..... 405/107; 405/102; 405/104

(58) Field of Search ..... 405/87, 92, 94, 405/99–102, 107, 103, 104

(56) References Cited

U.S. PATENT DOCUMENTS

| | | | | |
|---|---|---|---|---|
| 4,310,262 A | * | 1/1982 | Calza et al. | 405/87 |
| 4,478,534 A | * | 10/1984 | McIlwain | 405/96 |
| 5,199,812 A | * | 4/1993 | McClellan | 405/101 |
| 5,460,462 A | * | 10/1995 | Regan | 405/104 |
| 5,984,575 A | * | 11/1999 | Knott, Sr. | 405/92 |
| 6,338,594 B1 | * | 1/2002 | Adler et al. | 405/104 |

FOREIGN PATENT DOCUMENTS

| | | |
|---|---|---|
| JP | 2-240312 | 9/1990 |
| JP | 2566458 | 10/1996 |

* cited by examiner

*Primary Examiner*—Thomas B. Will
*Assistant Examiner*—Tara L. Mayo
(74) *Attorney, Agent, or Firm*—Armstrong, Westerman & Hattori, LLP

(57) ABSTRACT

The present invention provides a movable water-protection apparatus capable of driving a water barrier plate manually or automatically when needed. The movable water-protection apparatus includes a water barrier plate (2, 50) for shutting out water, such as seawater, river water, and rainwater, likely to intrude into a basement (G) and a driving device for driving the water barrier plate (2, 50) upward from an underground position along a guide device (10) or a side plate (60). The water barrier plate (2, 50) is disposed in an underground space at an entrance of the basement (G). The driving device has a water pressure type piston/cylinder unit (20) to which service water is supplied.

4 Claims, 3 Drawing Sheets

(a)

(b)

(a)

(b)

(c)

MOVABLE WATER-PROTECTION APPARATUS

FIELD OF THE INVENTION

The present invention relates to a movable water-protection apparatus having a water barrier plate for shutting out water, such as seawater, river water and rainwater, likely to intrude into a basement or for preventing water from running over a seawall, levee or the like, and a driving device for driving the water barrier plate from a predetermined position along a guide device, or for swingably driving the water barrier plate while contacting a side plate.

BACKGROUND OF THE INVENTION

A movable water-protection apparatus for preventing a house or building from being flooded by river water, rainwater or the like has heretofore been suggested. This conventional movable water-protection apparatus has a float and a water barrier plate attached to the float. Thus, when a water level is increased, the created buoyancy of the float allows the water barrier plate to be stood up so as to prevent a house or building from being flooded by river water, rainwater or the like. A movable levee apparatus for preventing overflow of river water during a flood has also been suggested in, for example, Japanese Patent Laid-Open Publication No. Hei 2-240312. This movable levee apparatus comprises a rotating shaft provided on top of a levee, a plurality of arms respectively extending from the rotating shaft, a plurality of shield plates each of which has a predetermined area and is attached to the arms, and an electric driving unit for driving the shield plates. Thus, the height of the levee may be additionally increased by rotating the shield plates through rotating the arms with the driving unit, as needed. The levee is consequently raised so that overflow of river water during a flood may be prevented.

As described above, in the conventional movable water-protection apparatus using a float, since the water barrier plate can be driven by the float, it is advantageous that a driving source is not required and the apparatus may be activated even during power failure. However, since the activation of the float is subject to a particular increased water level, there is some uncertainty of effective operation. The location for installing the water barrier plate is automatically determined depending on its intended purpose, while the float must be provided at the location where the water level will be surely increased during flood. Thus, in the actual implementation of this apparatus, it is supposed that the water barrier plate and the float can be separately located. This separated layout results in a complicated interlock mechanism between them and increased mechanical resistance. As a result, it may be difficult to drive the water barrier plate only by the float. Such problem may be solved by applying a larger float, but another problem will crop up in connection with an additional storage space for the large float which is not used except in an emergency. For these reasons, the movable water-protection apparatus using a float has problems in actual applications for houses or basements. The above conventional movable levee apparatus for river water is provided with the shield plates, and may be used as an additional levee by driving the shield plates with the driving unit in an emergency, such as overflow of river water. In a normal situation, a walkway may be provided under the shield plates, and the shield plates may also be utilized as a rain cover, sunshade and the like. However, this apparatus has problems. For example, since the shield plates have relatively large areas and are provided at the top of the levee, the shield plates are an impeditive to the view of the levee and can destroy the scenery around river. In an emergency, such as a disaster, electric power cannot be occasionally obtained due to power failure. In this case, since the shield plate of the conventional movable levee apparatus is subject to the electric driving unit, the apparatus cannot possibly function when the additional levee when needed. As for driving the shield plates manually, this is substantially impossible due to the weight of the shield plate. Such a manually driving mechanism is not disclosed in the Publication described above.

SUMMARY OF THE INVENTION

It is an object of the present invention to provide a movable water-protection apparatus in which the conventional problems or disadvantages as described above have been solved, and more specifically to provide a movable water-protection apparatus capable of reliably driving a water barrier plate manually or automatically when needed, without an excessive driving power and installation space for the water barrier plate.

The aforementioned object of the present invention is achieved by applying fluid, such as water, oil, and air, preferably service water or city water, to drive the water barrier plate. Generally, a typical building is equipped with a feed water tank, an emergency water tank, and the like. Thus, even in an emergency where service water cannot be obtained, the water barrier plate can be driven using the reserved water in such tanks.

In order to achieve the aforementioned objects, a movable water-protection apparatus according to a first aspect of the present invention comprises a water barrier plate for shutting out water, such as seawater, river water, and rainwater, likely to intrude into a basement or for preventing water from running over a seawall, levee or the like, and a driving device for driving the water barrier plate from a first predetermined position to a second predetermined position along a guide device, wherein the driving device includes a piston/cylinder unit which is activated by fluid pressure.

According to a second aspect of the present invention, a movable water-protection apparatus comprises a water barrier plate for shutting out water, such as seawater, river water, and rainwater, likely to intrude into a basement or for preventing water from running over a seawall, levee or the like, and a driving device for swingably driving the water barrier plate from a first predetermined position to a second predetermined position while contacting a side plate, wherein the driving device includes a piston/cylinder unit which is activated by fluid pressure.

In one embodiment of the present invention, the piston/cylinder unit which is activated by fluid pressure, according to the first or second aspect, may be a piston/cylinder unit which is activated by water pressure. In another embodiment of the present invention, the piston/cylinder unit which is activated by fluid pressure, according to the first or second aspect, may be a piston/cylinder unit which is activated by oil pressure.

In other embodiment of the present invention, the piston/cylinder unit which is activated by fluid pressure, according to the first or second aspect, may be adapted to be supplied with a predetermined pressure of fluid when a water likely to intrude into a basement or likely to run over seawall, levee or the like, is detected.

In yet other embodiment of the present invention, the water barrier plate according to either one of the first and second aspects and the above embodiments may be a water barrier plate for shutting out water likely to intrude into a basement, wherein the water barrier plate is disposed near an entrance of the basement and below a road surface, and a valve device for supplying and draining a predetermined pressure of fluid to and from the piston/cylinder unit is provided within the basement.

DETAILED DESCRIPTION OF THE PREFERRED EMBODIMENT

With reference to the accompanying drawings, embodiments of the present invention, in which a water pressure type piston/cylinder unit is applied to a driving device, will be described hereinafter. The movable water-protection apparatus according to the present invention will be readily understood from the embodiments of the present invention described hereinafter. For example, the movable water-protection apparatus according to the present invention may be applied to a seawall, levee or the like which is long in the width direction, by joining up a plurality of water barrier plates with an adequate clearance in the lateral direction and by using a plurality of water pressure type piston/cylinder units. Thus, embodiments in which one water barrier plate is applied to an entrance of a basement will be representatively described hereinafter.

Figure 1:
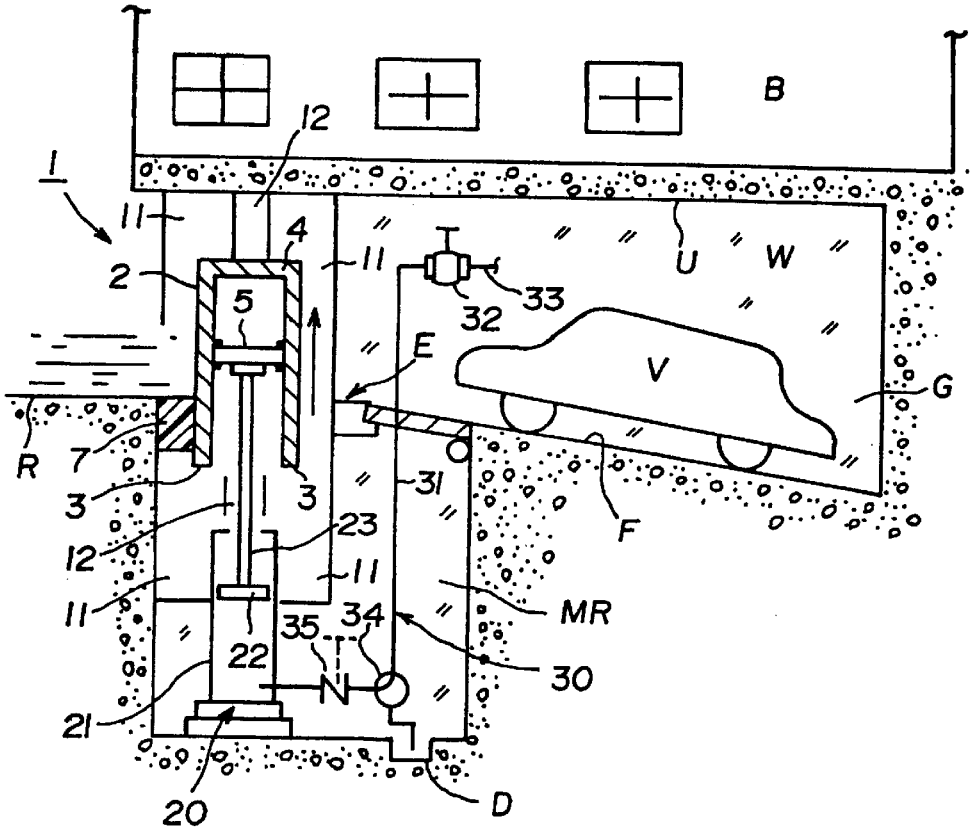
FIG. 1 illustrates a first embodiment of the present invention, wherein FIG. 1(*a*) is a schematic cross-sectional view showing the embodiment of a state where intruding water into a basement is blocked, and FIG. 1(*b*) is a perspective view showing a part of the embodiment in a normal state.
Figure 1:
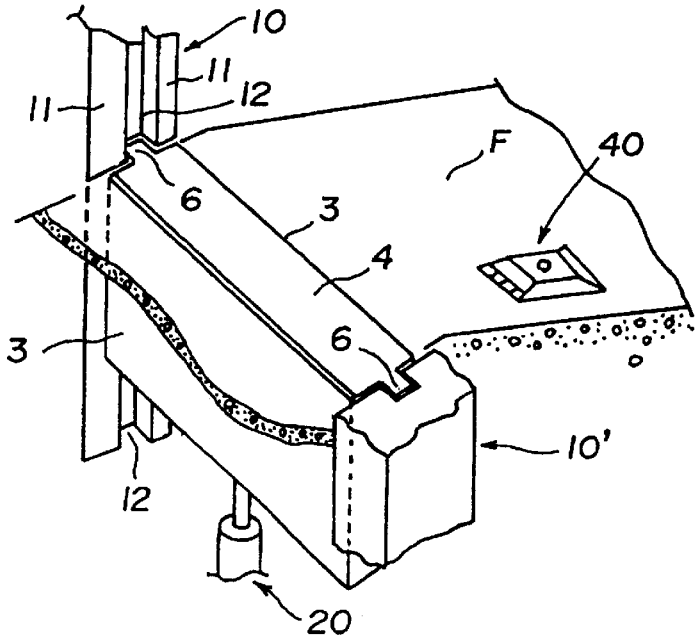

FIGS. 1(*a*) and (*b*) illustrate a cross-sectional view and a perspective view according to the first embodiment of the present invention, respectively. As shown in FIGS. 1(*a*) and (*b*), a movable water-protection apparatus 1, according to the first embodiment, includes a water barrier plate 2, which is located near an entrance E of a basement G and below a road surface R, in a normal state.

A floor F of the basement G is generally positioned below a ground surface or the road surface R. In the illustrated embodiment, the basement G is constructed in a box shape comprising the floor F slanted downward from the entrance E to the back, a sidewall W, and a ceiling U. The basement G is used as a garage for an automobile V. The floor F near the entrance E of the basement G is hollowed out at a predetermined depth to form a machine room MR. A building B is built above the basement G. It is apparent that the basement G may be applied to various uses other than garage, such as a warehouse, store and housing.

The movable water-protection apparatus 1 comprises a water barrier plate 2, a pair of guide devices 10, 10' for slidably guiding the water barrier plate 2 with water-tightness, a water pressure type piston/cylinder unit 20 for driving the water barrier plate 2 upward and a feed water device 30 for supplying a predetermined pressure of service water to the piston/cylinder unit 20.

In the-present embodiment, the water barrier plate 2 comprises a pair of side plates 3, 3, each of which has a predetermined area, a pair of side portions (not shown) each of which has a predetermined width and though which the side plates 3, 3 are connected with each other, and a top plate 4 closing a top end of a space formed by the side plates 3, 3 and the side portions, so as to make an interior space take on a box shape. The water barrier plate 2 is disposed in a part of the machine room MR so as to allow the height of the top plate 4 to be equal to that of the road surface R in the normal state. As shown in FIG. 1(*b*), a convex guide 6 is vertically formed on both sides of the water barrier plate 2. The water barrier plate 2 is lightweight because it is formed in such a box shape. Thus, the water barrier plate 2 can be driven by a small size or capacity piston/cylinder unit 20. Despite the lightweight, the water barrier plate 2 has a sufficient stiffness due to a stay 5 secured in the water barrier plate 2, so that the automobile V can pass over the top plate 4 when the water barrier plate 2 is moved downward from a position shown in FIG. 1(*a*) to a normal position in the normal state where the height of the top plate 4 is equal to that of the road surface R. In the normal state, while not shown in the drawings, a lower end of the water barrier plate 2 is reliably supported by a support member or stopper which is not shown in FIG. 1.

Since the pair of guide devices 10, 10' have a symmetrically identical structure as each other, the guide device 10 will be representatively described hereinafter. As for the other guide device 10', same elements are identified by adding a dash ' to the same reference numerals and their description will be omitted. In the guide device 10, a guide channel 12 extending axially or vertically with a predetermined width is formed by a pair of flanges 11, 11. While not shown in FIG. 1, a seal member, such as rubber, is attached on both sides of the channel 12. Thus, the convex guide 6 of the water barrier plate 2 can be vertically guided with water-tightness by the guide channel 12. The pair of guide devices 10, 10' are provided upward from the machine room MR to a predetermined height on both sides of the entrance E of the basement G with the guide channels 12, 12' facing each other.

The piston/cylinder unit 20 comprises a water pressure cylinder 21, a piston 22 reciprocatably inserted in the water pressure cylinder 21, and a piston rod 23 fixed to the piston 22. A top portion of the piston rod 23 is fixed to the stay 5 of the water barrier plate 2 with a bolt or the like. A bottom portion of the water pressure cylinder 21 is fixed to a floor of the machine room MR. In the present embodiment, while service water is supplied to the piston/cylinder unit 20, the water pressure of the service water is not that high. Thus, the piston/cylinder unit 20 may be formed of reinforced plastics which is corrosion-free and easy on maintenance.

The feed water device 30 includes a feed water pipe 31. One end of the feed water pipe 31 is connected to a service water pipe 33 through a control valve 32. The other end of the feed water pipe 31 is connected to a piston head chamber of the piston/cylinder unit 20 through a three-way valve 34, a check valve 35 and the like interposed in the feed water pipe 31. In the present embodiment, the control valve 32 is disposed within the basement G. Thus, even if a person stays in the basement G, the person can open the control valve 32 for supplying service water into the piston/cylinder unit 20 to drive the water barrier plate 2 upward, so that the person can avoid having the basement intruded by water. In addition, the check valve 35 is interposed in the feed water pipe 31 so that the water barrier plate 2 can avoid being moved downward even if the supply of the service water is stopped for some reason after the water barrier plate 2 has already been lifted up.

Operations of the present embodiment will be described hereinafter. In the normal state, the check valve 35 is operated to release a non-return action thereof, and the three-way valve 34 is switched from a first state shown in FIG. 1(*a*) to a second state for draining water. Thus, the water in the water pressure cylinder 21 of the piston/cylinder unit 20 is drained through the check valve 35 and the three-way valve 34 to a drain ditch D. Then, the water barrier plate 2 is moved downward by it's own weight until the water barrier plate 2 contacts a support member or stopper. The top plate 4 of the water barrier plate 2 eventually takes on approximately the same height as that of the road surface R. This state is shown in FIG. 1(*b*). Since the top plate 4 of the water barrier plate 2 acts as a part of the floor F, the basement G can be utilized as usual without concern for the water barrier plate 2.

When water is likely to intrude into the basement G, i.e. the basement G is likely to be flooded, the three-way valve 34 is switched to the position shown in FIG. 1(*a*), and the control valve 32 is then opened. Thus, service water is supplied to the water pressure cylinder 21 of the piston/cylinder unit 20 through the feed water pipe 31. The piston 22 is thereby driven upward, and the water barrier plate 2 is thus driven upward. This prevents water from intruding into the basement. G. The state for blocking water intrusion is shown in FIG. 1(*a*). In this state, a seal member 7, such as rubber, is provided at an opening of the machine room MR on an upstream side or outdoor side of the entrance E, so that water intrusion into the machine room MR can also be prevented. While not shown in FIG. 1, since a stopper is attached to the piston/cylinder unit 20 or the guide device 10 in order to limit an upward distance of the water barrier plate 2, the water barrier plate 2 is stopped at a predetermined position even if service water is continuously supplied. In this state, the piston/cylinder unit 20 and the other components can avoid damaged due to relatively high pressure of service water. If necessary, a pressure-reducing valve may be interposed in the feed water pipe 31.

Figure 2:
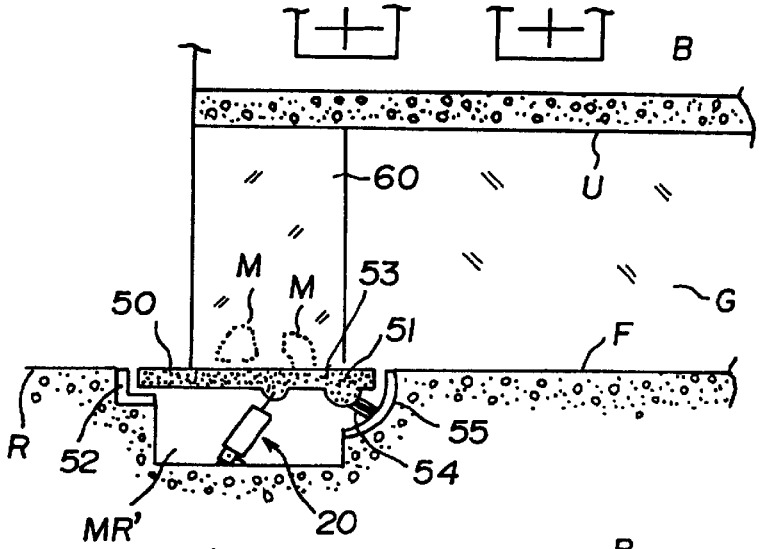
FIG. 2 illustrates a second embodiment of the present invention, wherein FIG. 2(*a*) is a schematic cross-sectional view showing the embodiment in a normal state, FIG. 2(*b*) is a schematic cross-sectional view showing the embodiment of a state where intruding water into a basement is blocked, and FIG. 2(*c*) is a schematic sectional side elevation of FIG. 2(*b*).
Figure 2:
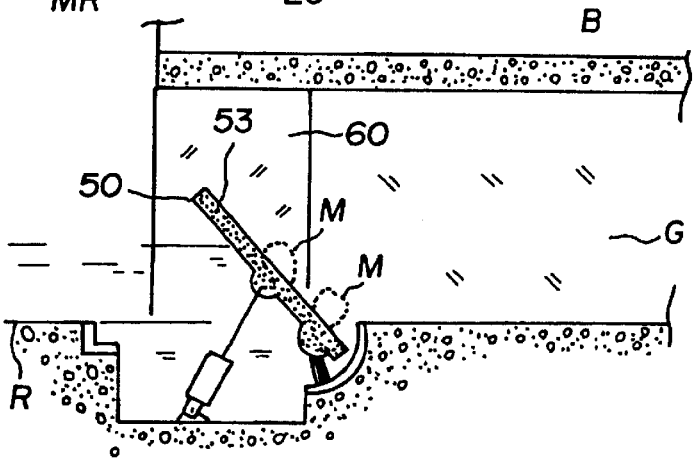
Figure 2:
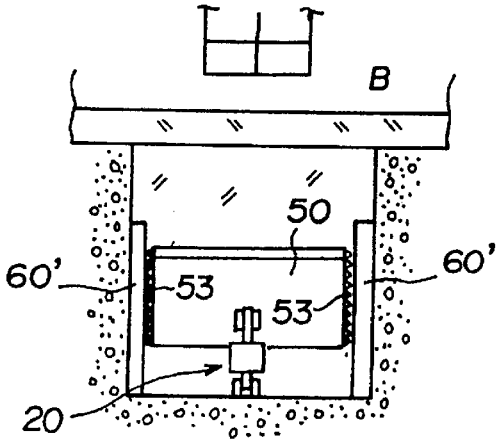

With reference to FIG. 2, a second embodiment of the present invention will be described hereinafter. The same elements of structure as the first embodiment are identified by the same reference numerals or by adding a dash ' to the same reference numerals and their description will be omitted. The second embodiment may be implemented in the case where it is difficult to assure a deep machine room MR due to existence of some object below ground. Whereas the water barrier plate 2 is slid in the first embodiment, a water barrier plate 50 according to the second embodiment comprises a swing plate which is swingably driven. More specifically, a relatively shallow machine room MR' is hollowed near the entrance of the basement G, and the water barrier plate 50 is horizontally disposed at an upper portion of the machine room MR' so as to form. a part of the floor surface of the basement G in the normal state. That is, a base end portion of the water barrier plate 50 is swingably pivoted at a pivot point 51, while a top portion thereof is supported by a support plate 52 formed in the road surface R.

This state is shown in FIG. 2(*a*). One end of the piston/cylinder unit 20 is pivoted at the floor of the machine room MR', while the other end thereof is pivoted approximately at the center of an under surface of the water barrier plate 50. Concrete placed on the sidewall of the basement G is often covered with a decorative board, panel or plate. In FIGS. 2(*a*) and (*b*), such a plate 60 is attached to the sidewall of the basement 6. In this case, a seal member 53, such as rubber, is provided on both sides of the water barrier plate 50. When the water barrier plate 50 is swingably driven by the piston/cylinder unit 20, both sides of the water barrier plate 50 are driven while contacting the plate 60 through the seal member 53. When the concrete is bare, a side plate 60' for sealing may be additionally provided on the sidewall as shown in FIG. 2(*c*). A seal member 54 is provided near the pivot point 51 of the water barrier plate 50. Thus, when the water barrier plate 50 is swingably driven, the seal member 54 is also contacted to a seal-receiving member 55 having an approximate arc shape and formed in the ground, so as to prevent water intrusion into the basement G.

When service water is supplied into the piston/cylinder unit 20 in the same way as described above, the water barrier plate 50 of the second embodiment is swung around the pivot point 51 to prevent water intrusion into the basement G. The state where water intrusion is prevented is shown in FIG. 2(*b*). According to the second embodiment, since the water barrier plate 50 is swingably driven, the machine room MR' can be formed in a shallow structure, resulting in lower construction cost. Even if some articles are placed on the water barrier plate 50, the water barrier plate 50 can be driven without removing the articles in case of an emergency. Further, according to the second embodiment, the piston/cylinder unit 20 is located outside the water barrier plate 50. This provides an advantage that, even if the piston/cylinder unit 20 is damaged, the resulting leaked service water does not entered into the basement G. However, it is apparently understood that the pivot point 51 and the piston/cylinder unit 20 may be arranged outside and on the side of the basement G, respectively.

The present invention can be embodied in various forms without being limited to the aforementioned embodiments. For example, when a building is equipped with a feed water tank, connecting the feed water pipe 31 with this feed water tank enables the water barrier plate 2, 50 to be driven even if service water is stopped. When a building is equipped with a rainwater tank, an emergency water tank or the like, the feed water pipe 31 may be connected with such a tank. Further, the service water pipe, the feed water tank, the rainwater tank, and the like may also be connected respectively in parallel with the feed water pipe 31. This provides an advantage that the water barrier plate 2, 50 can be driven by either one of them in the case of an emergency. Further, it is apparently understood that the water barrier plate 2 may be made from a simple plank or sheet. When the water barrier plate 2 of the first embodiment cannot be evacuated vertically to a predetermined depth due to the existence of some underground structure, the water barrier plate 2 may be adapted to evacuate at an adequate slant. In this case, the guide device 10 is also disposed at the slant.

While the water barrier plate 2, 50 is driven upward from an underground position in the first and second embodiments, it is possible for it to be driven, inversely, i.e. downward from above. For example, the water barrier plate 2 may be disposed within a wall of the building B located above the basement G and may be adapted to be driven downward from the interior of the wall toward the entrance. Otherwise, the water barrier plate 50 of the second embodiment may be swingably provided in the ceiling U of the basement G and may be adapted to be swingably driven downward. When the water barrier plate is adapted to be driven downward from above as described above, the entrance can be fully blocked up and this possibly causes a danger that a person is left in the basement G. Thus, it is desirably adapted to provide a predetermined clearance between the water barrier plate 2, 50 and the ceiling U. In the first and second embodiments, a one-way mechanism, such as a ratchet mechanism, capable of being manually released may also be provided so as to retain the water barrier plate 2, 50 at a desired position in each case.

Figure 3:
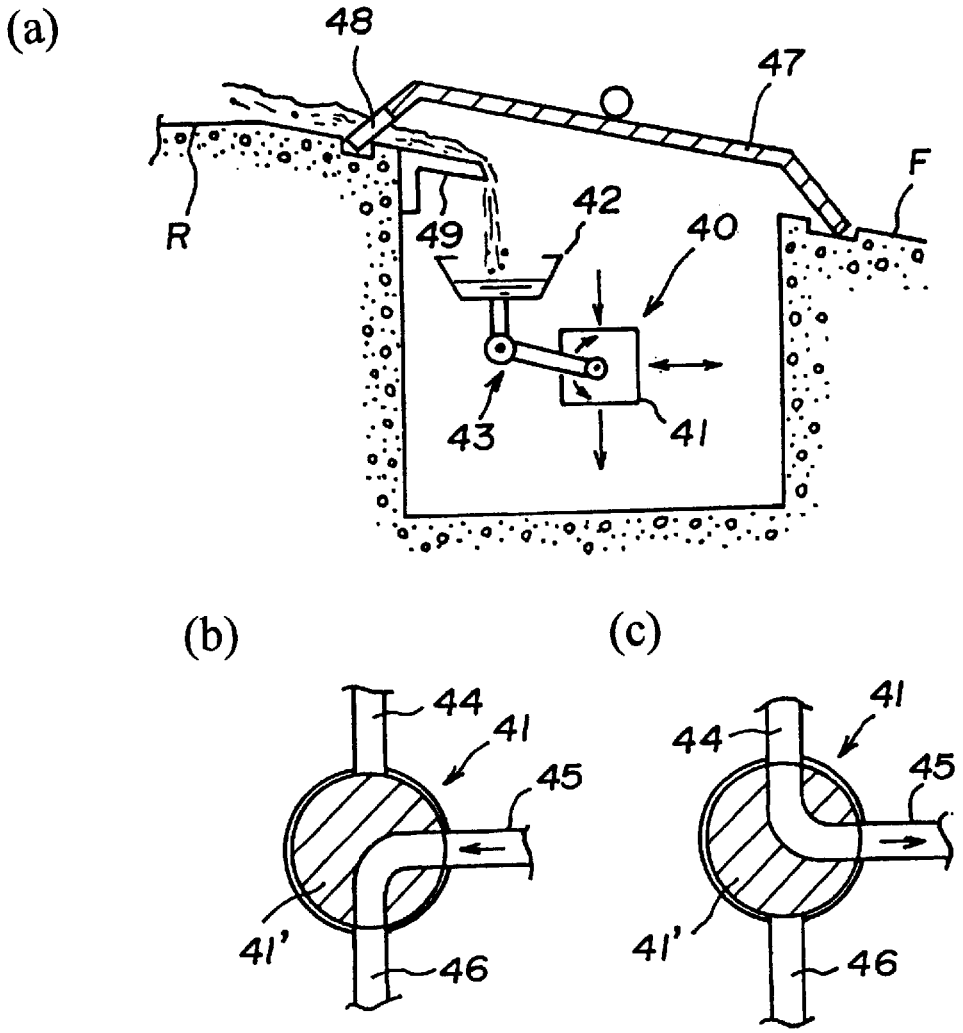
FIG. 3 illustrates an automatic feed water device, wherein FIG. 3(*a*) is a schematic cross-sectional view totally showing the device, and FIGS. 3(*b*) and (*c*) are cross-sectional views showing a control valve in differently switched states, respectively.

While service water is supplied into the water pressure cylinder 21 of the piston/cylinder unit 20 through a manual operation of the control valve 32 in the embodiments described above, the water barrier plate 2 may otherwise be adapted to be automatically driven by detecting if water is likely to intrude into the basement. This embodiment is shown in FIG. 3. That is, as shown in FIG. 3(*a*), an automatic feed water device 40 comprises a switching valve 41, a water pan 42 for receiving intruding water and a link mechanism 43 for connecting the switching valve 41 and the water pan 42.

One end of the link mechanism 43 is mechanically connected to a valve element 41' of the switching valve 41. In the present embodiment, the switching valve 41 has three ports with a first feed water pipe 44 connected to the service water pipe 33, a second feed water pipe 45 connected to the water pressure cylinder 21 of the piston/cylinder unit 20, and a drain pipe 46 connected to the drain ditch D are coupled, respectively.

As shown in FIG. 1(*b*), the automatic feed water device 40 constructed as described above is provided in the floor F of the basement G at a position slightly lower than the road surface R. In FIG. 3, reference number 47 indicates a dust cover, reference number 48 indicates an opening through which intruding water is passed, and reference number 49 indicates a water chute for guiding the intruding water into the water pan 42.

The first feed water pipe 44 is connected to the service water pipe 33 to supply water to the switching valve 41 at all times. In the normal state, the valve element 41' of the switching valve 41 is switched to a position shown in FIG. 3(*b*) by means of a spring bias so as to connect the second feed water pipe 45 and the drain pipe 46. Thus, the water in the water pressure cylinder 21 of the piston/cylinder unit 20 is drained to the drain ditch D so that the water barrier plate 2, 50 is moved downward by it's own weight and is located at a position shown in FIG. 1(*b*) or FIG. 2(*a*). Once some water starts to intrude into the basement G, water passes through the opening 48 of the dust cover 47 and is then supplied into the water pan 42 through the water chute 49. When a predetermined amount of intruding water is stored in the water pan 42, the water pan 42 is moved downward by the weight of the stored water. Then, the valve element 41' of the switching valve 41 is rotated through the link mechanism 43. Thus, the first feed water pipe 44 and the second feed water pipe 45 are connected to each other so that service water is supplied into the water pressure cylinder 21 of the piston/cylinder unit 20 and the water barrier plate 2 is driven as described above. It is apparently understood that the first feed water pipe 44 may be connected to a water supply source other than the service water pipe, such as a feed water tank, a rainwater tank and the like. Further, it is understood that intruding water may be electrically detected and the switching valve be changed by the detected signal.

Further, while the driving device for driving the water barrier plate includes the piston/cylinder unit 20 in the above embodiments, it is apparently understood that the driving device may be composed of a different type of piston/cylinder unit actuated by other fluids, such as oil pressure, air pressure and the like. When the piston/cylinder unit is adapted to be actuated through such fluid pressures, it is apparent that an effect similar to that from the water pressure type can be achieved.

As described above, according to the present invention, since the driving device driving the water barrier plate for shutting out water, such as seawater, river water and rainwater, likely to intrude into a basement or for preventing water from running over a seawall, levee or the like, comprises the piston/cylinder unit actuated by fluid pressure, the water barrier plate can be driven to a predetermined position only by supplying a fluid, such as operating oil, service water or the like, to the piston/cylinder unit. Thus, the present invention can achieve a particular effect that water protection is reliably performed in the case of an emergency. In addition, the driving device comprising the piston/cylinder unit can yield an effect of providing a significantly simple and inexpensive structure. According to one embodiment of the present invention, the driving device composed of the piston/cylinder unit actuated by water pressure can use water other than service water, such as the water of a rainwater tank, an emergency water tank or the like. According to another embodiment of the present invention, the water barrier plate is a water barrier plate for shutting out water likely to intrude into a basement, wherein the water barrier plate is disposed near an entrance of the basement and below a road surface, and a valve device for supplying and draining a predetermined pressure of fluid to and from the piston/cylinder unit is provided within the basement. Thus, in addition to the above effects, it can be achieved that, even if a person stays in the basement, the person can open the control valve for supplying a fluid into the piston/cylinder unit to drive the water barrier plate to a predetermined position, so that the person can avoid being shut in the basement by intruding water.

What is claimed is:

1. A movable water-protection apparatus for shutting out water from a garage, said apparatus comprising:

a water barrier plate for shutting out water; and a; driving device for driving said water barrier plate from a first predetermined position to a second predetermined position along a guide device, wherein said driving device includes a piston/cylinder unit which is activated by domestic or tap service water; said water barrier plate being located below a surface of a roadway and being adapted to allow passage of an automobile while in its first position, and preventing infiltration of water while in its second position.

2. A movable water-protection apparatus for shutting out water from a garage, said apparatus comprising:

a water barrier plate for shutting out water; and a driving device for swingably driving said water barrier plate from a first predetermined position to a second predetermined position with contacting to a side plate, wherein said driving device includes a piston/cylinder unit which is activated by service water;

said water barrier plate being located below a surface of a roadway and being adapted to allow passage of an automobile while in its first position, and preventing infiltration of water while in its second position.

3. A movable water-protection apparatus as defined in claim 1 or 2, wherein said piston/cylinder unit which is activated by service water, is supplied with a predetermined pressure of fluid when protection from water intrusion is needed.

4. A movable water-protection apparatus as in claim 1 or 2, wherein said water barrier plate is disposed near an entrance of said garage and below a road surface, and a valve device for supplying and draining a predetermined pressure of service water to and from said piston/cylinder unit is provided within said garage.

* * * * *